US006691465B1

(12) United States Patent
Stephan

(10) Patent No.: US 6,691,465 B1
(45) Date of Patent: Feb. 17, 2004

(54) DOOR CLOSER ASSEMBLY FOR SLIDING DOORS

(76) Inventor: Robert M. Stephan, 12143 174$^{th}$ Ct. N., Jupiter, FL (US) 33478

( * ) Notice: Subject to any disclaimer, the term of this patent is extended or adjusted under 35 U.S.C. 154(b) by 0 days.

(21) Appl. No.: 10/105,824

(22) Filed: Mar. 25, 2002

(51) Int. Cl.$^{7}$ ..... E05D 15/06
(52) U.S. Cl. ..... 49/404; 16/72
(58) Field of Search ..... 49/404; 16/72, 16/77, 82, 85, 63, 71, 75, 76, DIG. 10

(56) References Cited

U.S. PATENT DOCUMENTS

| | | | | |
|---|---|---|---|---|
| 4,004,372 A | | 1/1977 | Beard et al. | |
| 4,097,957 A | * | 7/1978 | Kitutaka | 16/58 |
| 4,301,623 A | | 11/1981 | Demukai | |
| 4,757,642 A | | 7/1988 | Hahn | |
| 4,819,295 A | | 4/1989 | Kaftan | |
| 5,313,739 A | * | 5/1994 | Nelson et al. | 49/404 |
| 5,513,469 A | * | 5/1996 | Tajudeen et al. | 49/404 |
| 5,630,249 A | | 5/1997 | Rebai, Jr. | |
| 5,720,080 A | * | 2/1998 | Rose | 16/74 |
| 5,937,478 A | | 8/1999 | Regnier | |

FOREIGN PATENT DOCUMENTS

| | | | | |
|---|---|---|---|---|
| GB | 2096692 | * | 10/1982 | 49/404 |
| JP | 6-167163 | * | 6/1994 | 49/404 |

* cited by examiner

*Primary Examiner*—Jerry Redman
(74) *Attorney, Agent, or Firm*—Gold & Rizvi, P.A.; Glenn E. Gold; H. John Rizvi

(57) ABSTRACT

A sliding door closer assembly including an elongated anchor bracket that is attached to a wall section above the trailing edge of a sliding door. One end of a spring is attached to the anchor bracket at a selected point along the length thereof, and the opposite end of the spring is attached to the leading edge of the sliding door. Upon opening the sliding door, the spring is tensioned between the stationary anchor bracket and the advancing edge of the sliding door, and upon release of the sliding door, the tensioned spring pulls the sliding door back into the closed position as the spring returns to the non-tensioned configuration.

4 Claims, 5 Drawing Sheets

DOOR CLOSER ASSEMBLY FOR SLIDING DOORS

BACKGROUND OF THE INVENTION

1. Field of the Invention

The present invention relates generally to devices for closing sliding doors or screens, and more particularly to a sliding door closer assembly which may be easily installed on sliding doors or screens to automatically close the sliding doors or screens and the tension or closing force of which is easily adjustable.

2. Description of the Prior Art

Sliding glass or screen doors are very common in homes around the world. Such doors typically provide access between a den, living area or bedroom in the home and an outdoor patio, yard or balcony. During the spring and summer months, in pleasant weather, the sliding doors or screens may be opened and closed repeatedly throughout the day, particularly if the residents enjoy such outdoor amenities as an outdoor pool, spa, barbecue pit or lawn furniture. Frequently, however, during the course of normal activities the doors or screens are inadvertently left open. This provides abundant opportunities for insects, birds, animals and debris to enter the home. Furthermore, pets or children may wander out of the home through the open doors or screens and may become lost, fall off a balcony or fall into a pool. Moreover, a large volume of cool air on hot days, and warm air on cool days, has a tendency to escape the home through the open doors or screens, thus significantly increasing the expense of electric or heating bills.

A variety of devices are known in the art for ensuring automatic closure of sliding glass doors or screens. U.S. Pat. No. 4,004,372, dated Jan. 25, 1977, to Beard, et al., discloses a "Sliding Door Closer and Method and Apparatus for Installing the Same", which includes a coil spring and a cushioning element in combination therewith and is specifically constructed to facilitate attaching the same to a sliding door.

U.S. Pat. No. 4,301,623, dated Nov. 24, 1981, to Demukai, describes a "Semiautomatic Sliding Door Device with Tension Spring", including a sliding door, an outer framework slidably supporting the door for movement between the positions of "open" and "closed", and a driving device comprising a tension spring energizing the sliding door toward the "closed" position, a connecting wire, and a guide wheel for guiding the wire. The device includes a braking device comprising permanent magnets on the outer framework and a breaking plate made of copper or aluminum sheets on the sliding door.

U.S. Pat. No. 4,757,642, dated Jul. 19, 1988, to Hahn details a "Self-Closing Sliding Door System", wherein belts, sprockets, cables, pulleys, rods and springs and the like of a showcase, for example, are replaced by one or more constant force springs associated with a spring-retention cavity or other spring retainer. This permits the doors to be easily removed for servicing and for improved access to the interior of the showcase. The parts are simple and easy to replace, few moving parts are involved and the system is applicable both for new construction and for retrofitting to existing cases.

U.S. Pat. No. 4,819,295, dated Apr. 11, 1989, to Kaftan, describes a "Sliding Screen Closer", which can be vertically on the vertical, non-movable frame of a doorway. A tension cord extends inwardly from the door opening to be secured to the inboard end of a sliding screen or door to automatically pull the screen or door across the opening. The closer does not obstruct the opening when the screen or door is in the open position.

U.S. Pat. No. 5,630,249, dated May 20, 1997, to Rebai, Jr., details a "Sliding Screen Door Closing Device", including a housing mountable proximal to a sliding screen door. A retractable cable resiliently extends from the housing and couples with the sliding screen door to effect closing of the door subsequent to opening thereof.

U.S. Pat. No. 5,937,478, dated Aug. 17, 1999, to Regnier, discloses a "Sliding Door Closing Device", including a housing that attaches to the trailing edge of the sliding door. A tensioned cable extends from a spool in the housing to the door frame. When the sliding door is opened, the cable extends and undergoes an increase in tension. When the door is released, the cable is retracted and undergoes a decrease in tension as it forces the door closed. Cable tensioning is provided by a torsion spring that connects the cable spool to a concentric ratcheted axle. The device permits the user to readily increase or decrease the tension of the cable independently of the amount of cable extended by either ratcheting the axle with respect to the spool or by releasing the ratchet pawl.

Several drawbacks are inherent in many of the prior art door closing assemblies. For example, the assemblies are often complex in structure and operation, rendering them difficult to assemble and install and vulnerable to frequent malfunction. Moreover, the assemblies may be bulky and unsightly to the decor of the home.

Accordingly, there is a need for a sliding door or screen closing assembly which is relatively simple in construction and has relatively few parts; is easy to install and maintain; and is substantially hidden from view.

SUMMARY OF THE INVENTION

The present invention is directed to a sliding door closer assembly for automatically closing sliding doors or screens and which is simple in construction, easy to install, substantially hidden from view and the tension or door or screen closing force of which is easy to adjust.

An object of the present invention is to provide a sliding door closer assembly which can be retrofitted to sliding doors or screens of various design.

Another object of the present invention is to provide a door closing assembly that is simple in construction and operation.

Still another object of the present invention is to provide a door closing assembly that is easy to install on sliding doors or screens.

A still further object of the present invention is to provide a sliding door closer assembly which is reliable in operation and requires little or no maintenance.

Yet another object of the present invention is to provide a sliding door closer assembly which is substantially hidden from view to preserve the aesthetically-pleasing decor of a living room, den, or bedroom in a home.

A still further object of the present invention is to provide a sliding door closer assembly which can be cost-effectively manufactured and packaged and can be installed with minimum skill.

Yet another object of the present invention is to provide a sliding door closer assembly which can be easily adjusted to facilitate a desired closing force of a sliding door.

Another object of the present invention is to provide a sliding door closer assembly which has relatively few parts for ease in installation and operation.

In accordance with a preferred embodiment of the present invention, a sliding door closer assembly is provided which includes an elongated anchor bracket that is attached to a wall section above the trailing edge of a sliding door. One end of a spring is attached to the anchor bracket at a selected point along the length thereof, and the opposite end of the spring is attached to the leading edge of the sliding door. Upon opening the sliding door, the spring is tensioned between the stationary anchor bracket and the advancing edge of the sliding door, and upon release of the sliding door, the tensioned spring pulls the sliding door back into the closed position as the spring returns to the non-tensioned configuration.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed towards a sliding door closer assembly for automatically closing sliding doors or screens and which is simple in construction, easy to install, substantially hidden from view and the door or screen closing force of which is easy to adjust.

Figure 5:
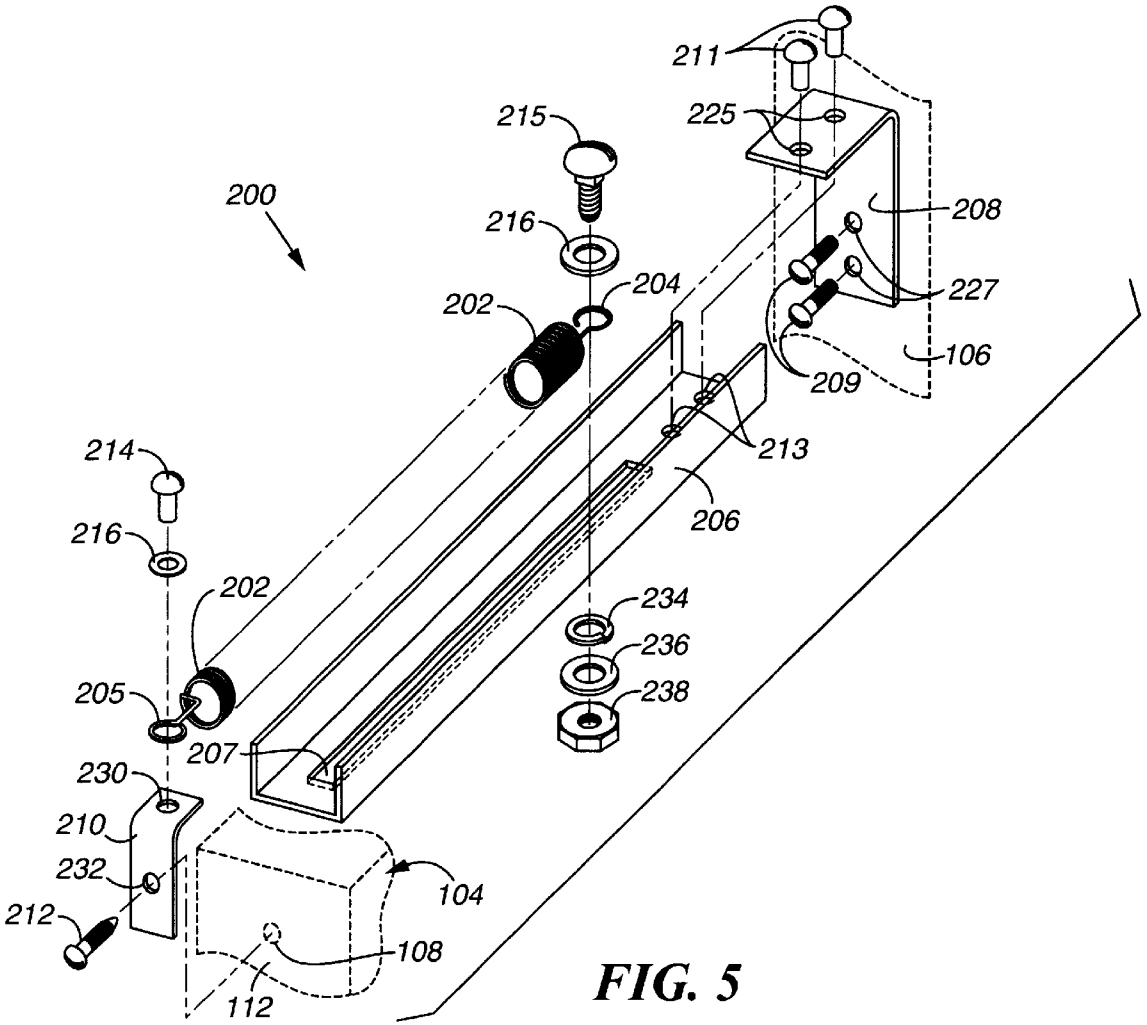
FIG. 5 is an exploded, perspective view of a preferred embodiment of the sliding door closer assembly of the present invention.

Referring initially to FIGS. 1, 2, 4 and 5 of the drawings, a preferred embodiment of the sliding door closer assembly of the present invention is generally indicated by reference numeral 200. The sliding door closer assembly 200 may be retro-fitted to a conventional sliding screen or sliding door 104, which typically slides in a bottom floor track (not illustrated) from the closed position illustrated in FIG. 1 to an open position in which the sliding door 104 is positioned behind an adjacent fixed screen or fixed door 102. The sliding door closer assembly 200 is typically disposed on the upper surface of the sliding door 104, within the jam space conventionally defined above the sliding door 104, and thus, is maintained out of view of persons in the area of the sliding door closer assembly 200. The sliding door closer assembly 200 includes an elongated, typically U-shaped or channel-shaped anchor bracket 206 typically having a U-shaped cross-sectional configuration and an elongated adjusting slot 207 provided in the bottom thereof. The anchor bracket 206 is fixedly attached typically by means of an inverted L-shaped wall bracket 208 to a wall section or door frame 106 adjacent to the trailing edge 110 of the sliding door 104. Accordingly, as illustrated in FIG. 5, the vertical segment of the wall bracket 208 may be attached to the wall section 106 by extending a pair of wall bracket screws 209 through respective wall bracket screw openings 227 in the wall bracket 208 and threading the wall bracket screws 209 into respective wall screw openings (not illustrated) in the wall section 106. The anchor bracket 206 may be attached to the horizontal segment of the wall bracket 208 by extending a pair of rivets 211 or like fasteners through respective wall bracket rivet openings 225 in the wall bracket 208 and through respective anchor bracket rivet openings 213 in the bottom of the anchor bracket 206. It is understood that the wall bracket 208 may be attached to the wall section 106 using any other method known by those skilled in the art, and the anchor bracket 206 may alternatively be integrally attached or welded to the wall bracket 208. When the anchor bracket 206 is so mounted on the wall bracket 208, the anchor bracket 206 is typically supported in cantilever fashion a slight distance above the top surface of the sliding door 104 by the wall bracket 208 when the sliding door 104 is in the closed position of FIGS. 1 and 2.

The sliding door closer assembly 200 further includes an elongated spring 202 of selected strength and material, which spring 202 includes a stationary spring end loop 204 and a traveling spring end loop 205. The stationary spring end loop 204 is adjustably attached to the anchor bracket 206 at a selected point along the length of the adjusting slot 207 by extending a box screw 215 or like fastener typically first through a flat washer 216, then through the stationary spring end loop 204 of the spring 202 and through the adjusting slot 207, respectively. A split lock washer 234 and a flat washer 236 may be inserted on the box screw 215 before threading a securing hex nut 238 thereon. Accordingly, the position of the stationary spring end loop 204 of the spring 202 along the adjusting slot 207 may be adjusted for purposes hereinafter described, by initially loosening the hex nut 238 on the box screw 215; manually sliding the box screw 215 along the adjusting slot 207 to the desired location therealong to apply a selected tension on the spring 202; and tightening the hex nut 238 against the flat washer 236. It is understood that various other mechanisms may be used to adjustably mount the stationary spring end loop 204 on the anchor bracket 206, the box screw 215 and associated components heretofore described being only one example of such a mechanism. The traveling spring end loop 205 of the spring 202 is attached to the leading edge 112 of the sliding door 104, typically by means of an inverted L-shaped sliding door bracket 210. Accordingly, the sliding door bracket 210 may be attached to the sliding door 104 by extending a self-tapping screw 212 or like fastener first through a screw opening 232 in the sliding door bracket 210 and then threading the self-tapping screw 212 into a registering screw opening 108 in the leading edge 112 of the sliding door. The spring 202 may then be attached to the sliding door bracket 210 by extending a rivet 214 or like fastener typically first through a flat washer 216, then through the traveling spring end loop 205 and a registering rivet opening 230 provided in the sliding door bracket 210, respectively, to attach the spring 202 to the sliding door bracket 210. It is understood that any alternative mechanism or technique known by those skilled in the art may be used to attach the traveling spring end loop 205 of the spring 202 to the sliding door 104.

Furthermore, while the spring 202 shown in the drawings has a continuous, one-piece construction, it is understood that the spring 202 may instead be constructed of multiple interconnected spring segments (not illustrated) attached to the wall bracket 208 and to the sliding door bracket 210.

Figure 1:
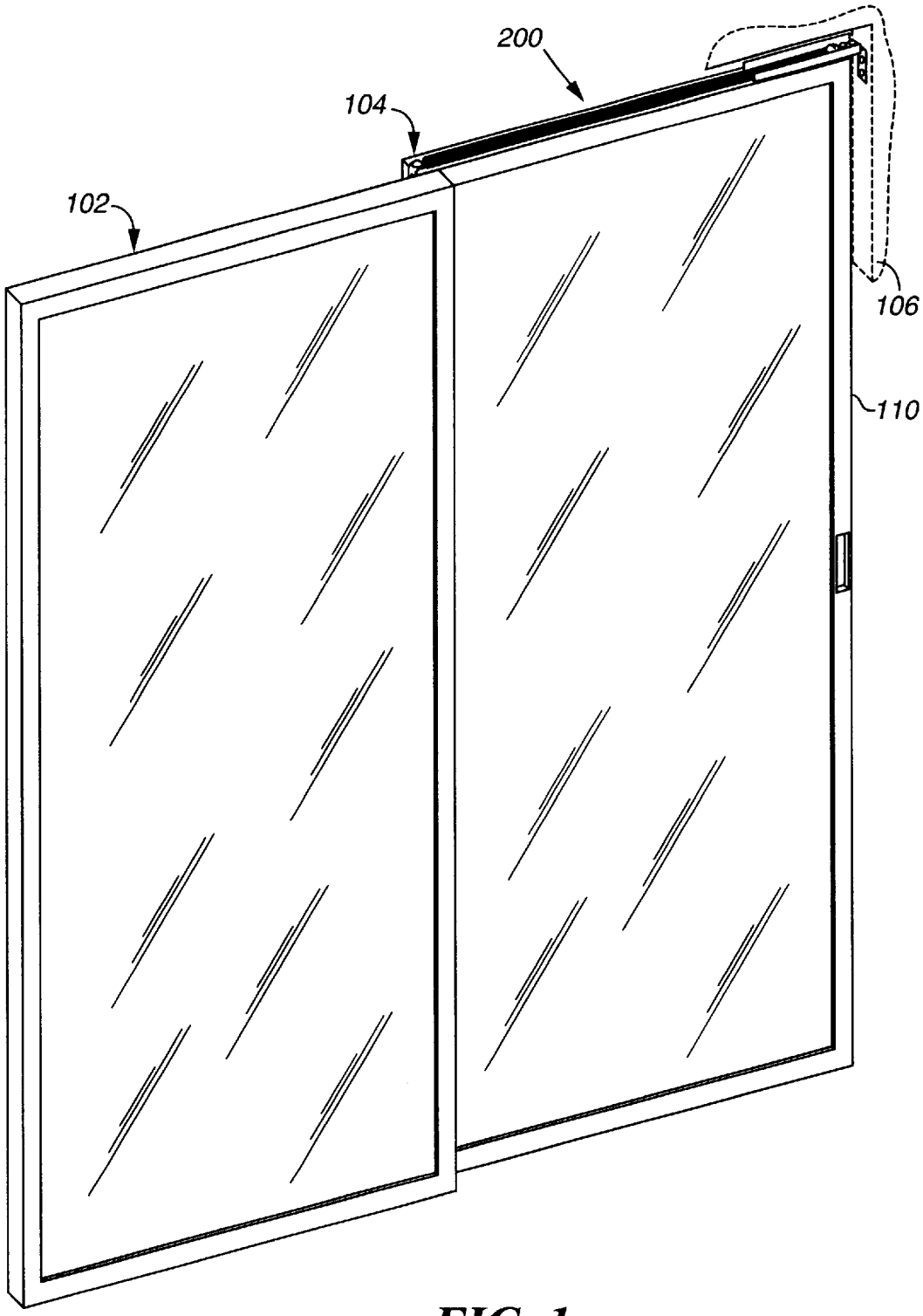
FIG. 1 is a perspective view of a conventional sliding glass door, with a preferred embodiment of the sliding door closer assembly of the present invention mounted in place and the sliding glass door shown in the closed position.
Figure 2:
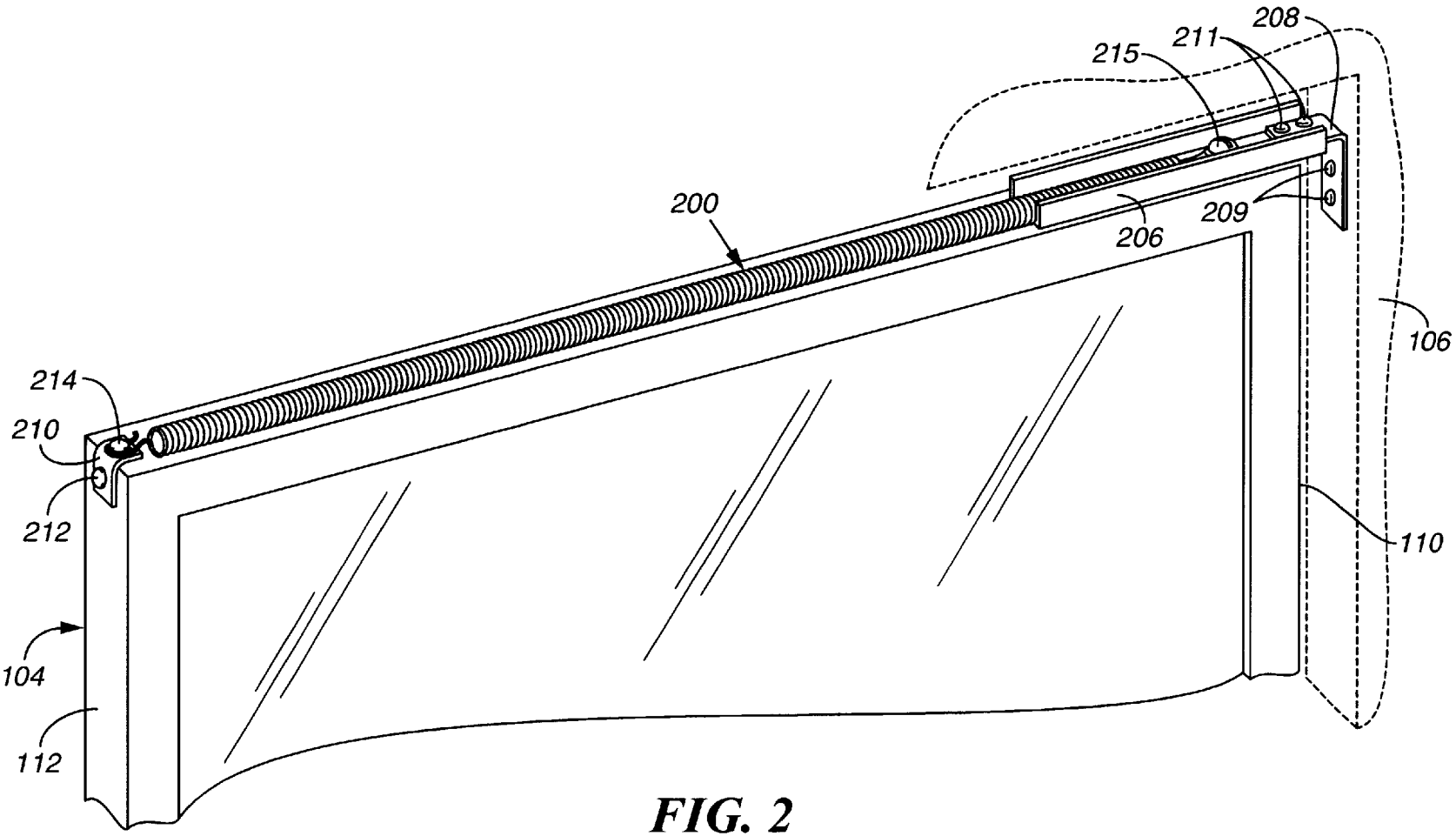
FIG. 2 is a perspective view of the sliding door closer assembly of the present invention, with the sliding glass door (in section) shown in the closed position and the spring element of the sliding door closer assembly shown in the non-tensioned configuration.
Figure 3:
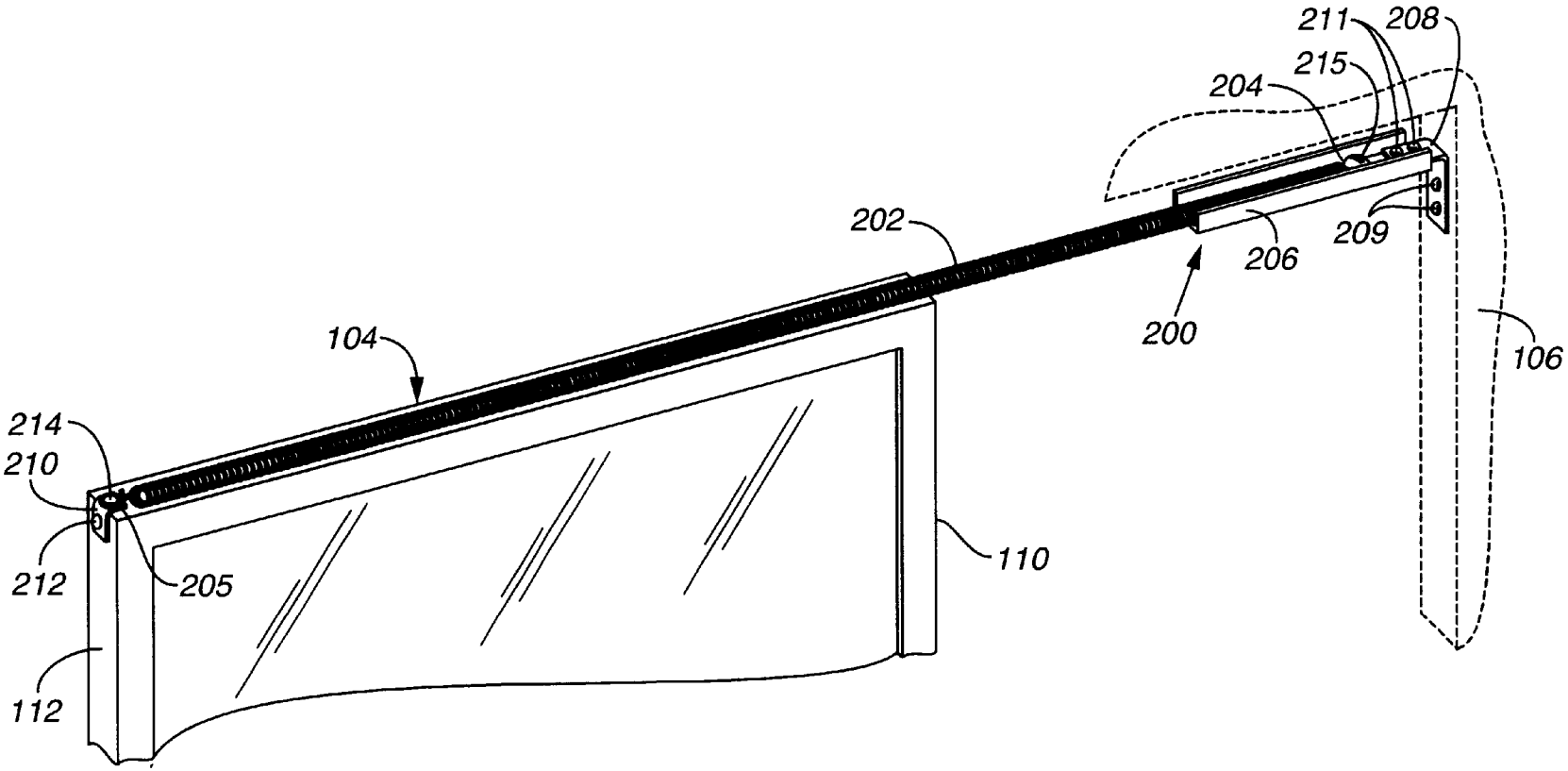
FIG. 3 is a perspective view of the sliding door closer assembly of the present invention, with the sliding glass door shown in the open position and the spring element of the sliding door closer assembly shown in the tensioned configuration.
Figure 4:
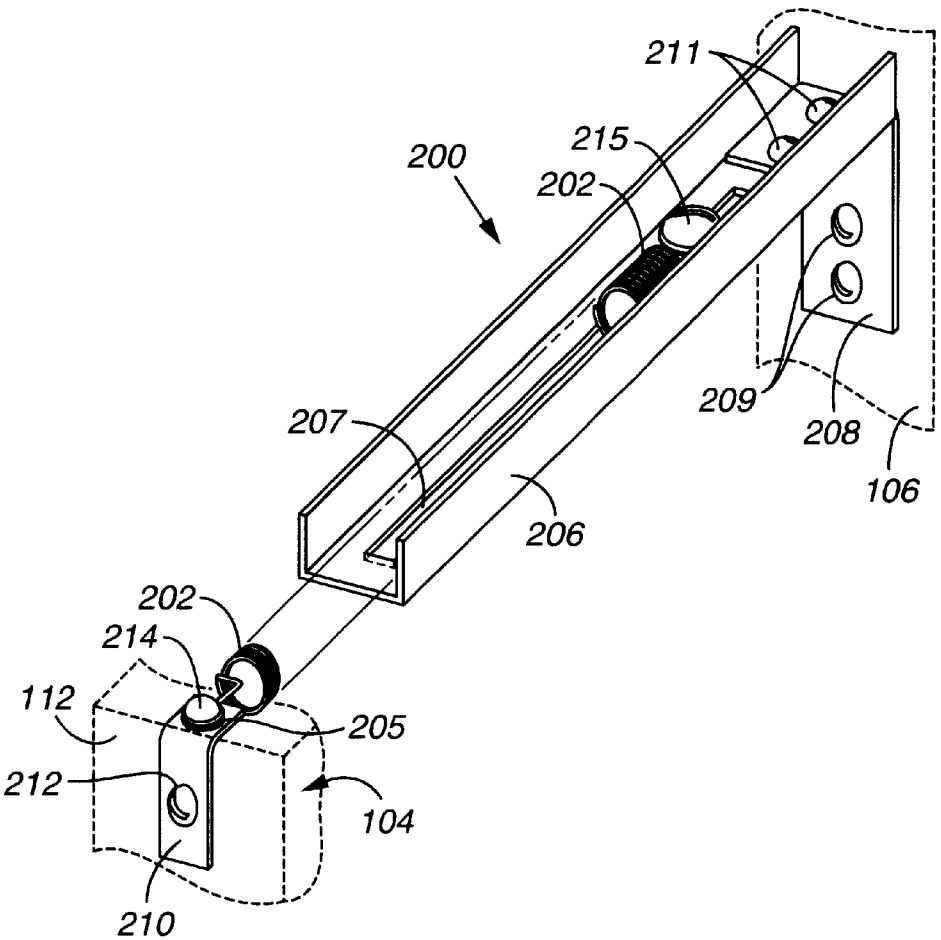
FIG. 4 is a perspective view of the sliding door closer assembly of the present invention, more particularly detailing a preferred, bracket technique for mounting the assembly on a wall section and on the sliding glass door.

Referring next to FIGS. 1–3 of the drawings, in application the sliding door closer assembly 200 functions to maintain the sliding door 104 in the closed position of FIGS. 1 and 2, wherein the sliding door 104 is positioned adjacent to the fixed door 102. Upon opening of the sliding door 104, as illustrated in FIG. 3, the bottom end of the sliding door 104 slides along a floor track (not illustrated) to a position behind the fixed door 102, in conventional fashion. Simultaneously, the sliding door bracket 210, fixedly attached to the leading edge 112 of the sliding door 104, pulls the attached traveling spring end loop 205 away from the stationary spring end loop 204 of the spring 202, and this action tensions the spring 202 for as long as the sliding door 104 is held in an open position. Upon release of the sliding door 104, the tensioned spring 202 contracts and pulls the sliding door bracket 210 against the leading edge 112 of the sliding door 104. Consequently, the sliding door 104 slides along the bottom floor track (not illustrated) thereof until the sliding door 104 returns to the closed position of FIG. 1. In the foregoing manner, the sliding door closer assembly 200 prevents persons from inadvertently leaving the sliding door 104 in an open position.

It will be appreciated by those skilled in the art that the tension of the spring 202 can be adjusted, as desired, to compensate for reduced tension or pulling force in the spring 202 resulting from prolonged use thereof or to increase or decrease the closing force of the sliding door 104. Accordingly, tension of the spring 202 and thus, the closing force of the sliding door 104, is decreased, as desired, by initially loosening the hex nut 238 on the box screw 215; sliding the box screw 215 in the adjusting slot 207, toward the sliding door bracket 210; and re-tightening the hex nut 238 on the box screw 215 and against the flat washer 236. Conversely, tension of the spring 202 and the closing force of the sliding door 104 are increased, as desired, by loosening the hex nut 238, sliding the box screw 215 in the adjusting slot 207 toward the wall bracket 208 and re-tightening the hex nut 238.

The sliding door closer assembly may be installed on the sliding door 104 typically in the following manner. First, the wall bracket 208 is secured to the wall section 106 and the sliding door bracket 210 is attached to the leading edge 112 of the sliding door 104. Preferably, the anchor bracket 206 in the pre-assembly, packaged state is attached to the wall bracket 208. Next, the traveling spring end loop 205 of the spring 202 is attached to the sliding door bracket 210. Alternatively, the traveling spring end loop 205 may be attached to the sliding door bracket 210 prior to installation. The stationary spring end loop 204 is pulled across the top surface of the sliding door 104 and attached to the anchor bracket 206 at the selected location along the adjusting slot 207 by means of the box screw 215 or like fastener.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An assembly for maintaining a sliding door in a closed position against a stationary structure, said assembly comprising:

an anchor bracket for engaging the stationary structure, said anchor bracket having an elongated adjusting slot; and an elongated spring having a first end adjustably engaging said adjusting slot of said anchor bracket and a second end for engaging the sliding door, whereby tension is exerted on said spring upon movement of the door from said closed position to an open position away from the stationary structure and said tension is released as said spring returns the door from said open position to said closed position upon release of the door.

2. The assembly of claim 1 further comprising a sliding door bracket for engaging the sliding door and wherein said spring engages said sliding door bracket.

3. The assembly of claim 1 comprising a wall bracket for engaging the stationary structure and wherein said spring engages said wall bracket.

4. The assembly of claim 3 further comprising a sliding door bracket for engaging the sliding door and wherein said spring engages said sliding door bracket.

* * * * *